US006280017B1

(12) United States Patent
Miyauchi

(10) Patent No.: US 6,280,017 B1
(45) Date of Patent: Aug. 28, 2001

(54) RECORDING APPARATUS

(75) Inventor: Yasuo Miyauchi, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/425,892

(22) Filed: Oct. 25, 1999

(30) Foreign Application Priority Data

Oct. 27, 1998 (JP) ..... 10-306138

(51) Int. Cl.[7] ..... B41J 23/00
(52) U.S. Cl. ..... 347/49; 347/50
(58) Field of Search ..... 347/49, 50, 85, 347/86, 87, 40

(56) References Cited

U.S. PATENT DOCUMENTS 5,539,436 * 7/1996 Wilson et al. ..... 347/37
5,646,665 * 7/1997 Swanson et al. ..... 347/87
5,980,021 * 11/1999 Nagoshi et al. ..... 347/49
6,017,113 * 1/2000 Nicoloff, Jr. et al. ..... 347/40

FOREIGN PATENT DOCUMENTS 9-86012 3/1997 (JP) .

* cited by examiner

*Primary Examiner*—N. Le
*Assistant Examiner*—Anh T. N. Vo
(74) *Attorney, Agent, or Firm*—Fitzpatrick, Cella, Harper & Scinto

(57) ABSTRACT

The present invention provides a recording apparatus having a cartridge mounting member to which a cartridge is detachably mountable, having a connector adapted to effect electrical connection to the cartridge and having a first attached portion for receiving an attaching member for attaching the connector to the cartridge mounting member, a second attached portion provided on the cartridge mounting member and adapted to receive the attaching member when the connector is attached to the cartridge mounting member, and a substrate adapted to hold the connector and having a configuration in which the substrate is not contacted with the attaching member when the first and second attached portions are interconnected by the attaching member.

22 Claims, 9 Drawing Sheets

RECORDING APPARATUS

BACKGROUND OF THE INVENTION

1. Field of the Invention

The present invention relates to a construction and a method regarding electrical connection between a head mounting member of a recording apparatus and a head member detachably mountable on the head mounting member.

2. Related Background Art

In ink jet printers, conventionally, in many cases, electrical contact between a body side carriage and a detachable head has been effected by connecting a projection of a flexible cable provided on the carriage to a contact pad portion of a head cartridge.

In this case, a rubber pad having a projection is provided on a rear surface of the flexible cable so that positional error of a contact portion is absorbed by elasticity of rubber, thereby stabilizing contact pressure between the contacts. However, since the error absorbing ability of the rubber pad is poor and the elasticity of rubber varies with change in temperature, it may be difficult to obtain a positive contacting condition.

To cope with this, as disclosed in Japanese Patent Application Laid-open No. 9-86012 (1997), there is provided a technique in which a connector comprised of a plurality of metal connection pieces is attached to a carriage and the connector and a head cartridge are electrically connected to each other.

According to such a technique, the positional error absorbing range is increased by elasticity of the metal connection pieces, and, since the metal connection pieces are rocked completely independently, all of the contacts can be maintained in the positive contacting condition.

However, in the above-mentioned conventional example, since the metal connection pieces are arranged laterally in a line, when contacts are further increased, a length of the connector is increased accordingly, thereby making the head cartridge and the carriage more bulky.

Further, as the number of contacts is increased, a reaction force of contact pressure generated in each contact becomes great considerably. That is to say, if the connector is not secured to the carriage by a force overcoming such reaction force, the contacting condition becomes unstable.

In the past, since a portion of a contact substrate to which the connector is welded was secured to the carriage by screws, the contact substrate was flexed by the reaction force, with the result that the contacting condition might be unstable and/or the contact substrate might be damaged.

SUMMARY OF THE INVENTION

An object of the present invention is to provide a recording apparatus in which, while an external force caused during mounting of a head member is being prevented from acting on an electrical part attaching member to which electrical parts for electrically connecting between the head member and a head mounting member are attached, the electrical parts attached to the electrical part attaching member can positively be secured to the head mounting member. Further, an additional object is to provide a recording apparatus in which the electrical parts can be positioned on and secured to the head mounting member with high accuracy.

Another object of the present invention is to provide a recording apparatus of serial type in which, while an external force caused during mounting of a head member is being prevented from acting on an attaching substrate to which a connector for electrically connecting between the head member and a carriage are attached, the connector attached to the attaching substrate can positively be secured to the carriage. Further, an additional object is to provide a recording apparatus of serial type in which the connector can be positioned on and secured to the carriage with high accuracy.

A further object of the present invention is to provide a recording apparatus of full-line type in which, while an external force caused during mounting of a full-line head is being prevented from acting on an attaching substrate to which a connector for electrically connecting between the full-line head and a head mounting member are attached, the connector attached to the attaching substrate can positively be secured to the head mounting member. Further, an additional object is to provide a recording apparatus of full-line type in which the connector can be positioned on and secured to the head mounting member with high accuracy.

A still further object of the present invention is to provide a recording apparatus having a cartridge mounting member to which a cartridge is detachably mountable, comprising a connector adapted to effect electrical connection to the cartridge and having a first attached portion for receiving an attaching member for attaching the connector to the cartridge mounting member, a second attached portion provided on the cartridge mounting member and adapted to receive the attaching member when the connector is attached to the cartridge mounting member, and a substrate adapted to hold the connector and having a configuration in which the substrate is not contacted with the attaching member when the first and second attached portions are interconnected by the attaching member.

A further object of the present invention is to provide an ink jet recording apparatus for effecting recording by a head cartridge detachably mounted to a reciprocal carriage, wherein a contact substrate including a connector having a number of elastic metal connection pieces is attached to the carriage, and contact pads corresponding to the elastic metal connection pieces are provided on the head cartridge, and further wherein a housing portion of the connector is directly secured to the carriage by an attaching member and the contact substrate is configured to have an escape portion not interfered with the attaching member.

A still further object of the present invention is to provide an ink jet recording apparatus for effecting recording by a plurality of head cartridges detachably mounted to a reciprocal carriage, wherein a contact substrate including a plurality of connectors each having a number of elastic metal connection pieces is attached to the carriage, and contact pads corresponding to the elastic metal connection pieces are provided on each of the head cartridges, and further wherein a positioning spacer is inserted between the connectors and the contact substrate so that positioning between the connectors and the contact substrate is effected via the spacer, and housing portions of the connectors are directly secured to the carriage by attaching members and the contact substrate is configured to have escape portions not interfered with the attaching members.

The other object of the present invention is to provide a method for attaching an electrical substrate to a cartridge mounting member to which a cartridge is detachably mountable, comprising the steps of providing, on a connector for effecting electrical connection to the cartridge, a first attached portion for receiving an attaching member for attaching the connector to the cartridge mounting member, providing, on the cartridge mounting member, a second attached portion for receiving the attaching member when the connector is attached to the cartridge mounting member, and providing an escape portion in the substrate for holding the connector so that the substrate does not interfere with the attaching member when the first and second attached portions are secured to each other by the attaching member.

DETAILED DESCRIPTION OF THE PREFERRED EMBODIMENTS

The present invention will now be explained with reference to the accompanying drawings. However, the present invention is not limited to the following embodiments.

First Embodiment

Figure 1:
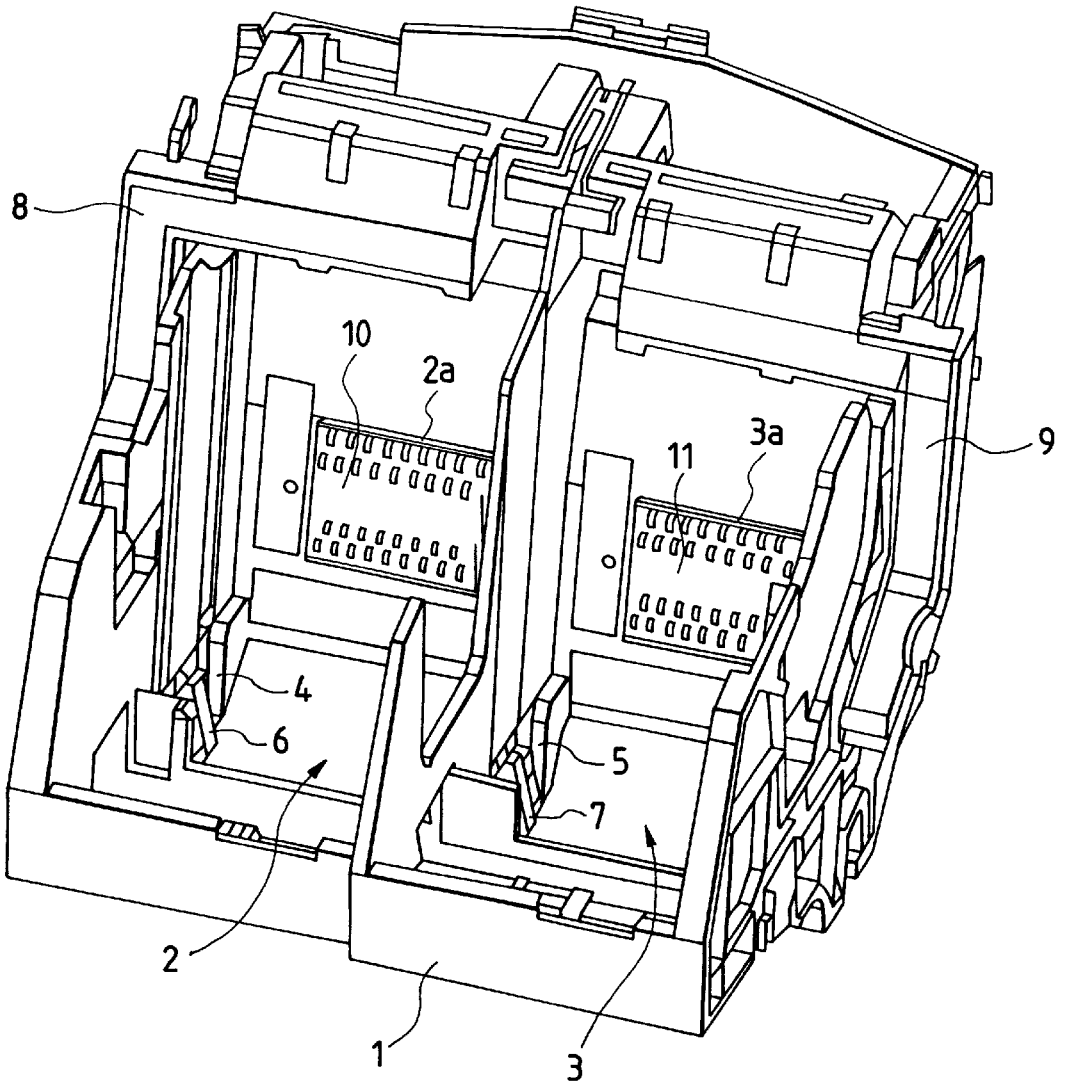
FIG. 1 is a perspective view for explaining a main body side carriage according to a first embodiment of the present invention.

FIG. 1 is a perspective view showing a first embodiment of the present invention. Two cartridges can be mounted on a carriage 1 which is partitioned into two pockets 2, 3. The pockets 2, 3 are provided with positioning grooves 4, 5 for the cartridges, side springs 6, 7 for preventing lateral deviation of the cartridges, and lock levers 8, 9 for pressing and securing the cartridges, respectively, and connectors 10, 11 are slightly protruded from corner windows 2*a*, 3*a* of the carriage 1.

Figure 2:
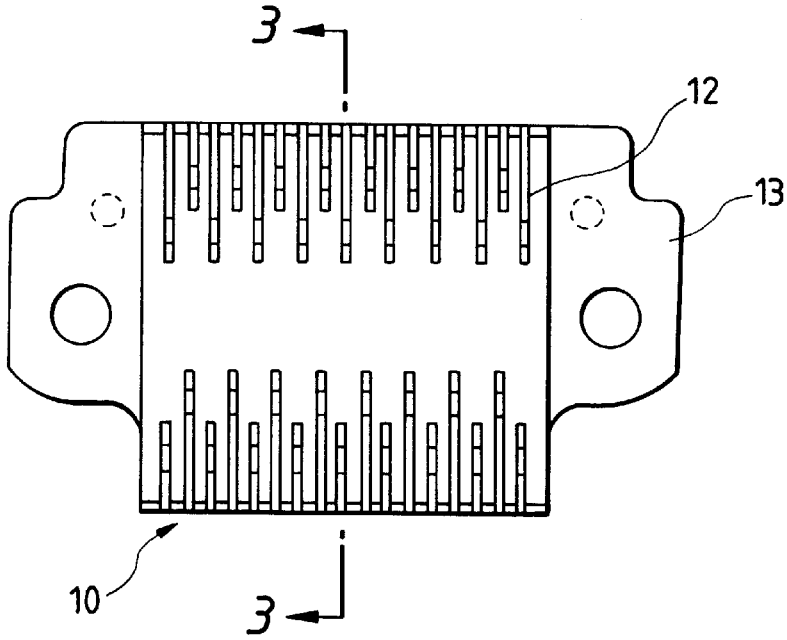
FIG. 2 is a plan view of a connector of FIG. 1.
Figure 3:
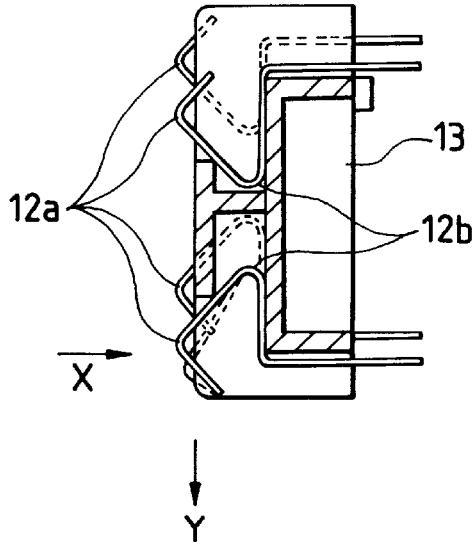
FIG. 3 is a sectional view of the connector taken along the line 3—3 in FIG. 2.

As shown in FIGS. 2 and 3 (FIG. 2 is a plan view, and FIG. 3 is a sectional view taken along the line 3—3 in FIG. 2), each of the connectors 10, 11 has a substantially U-shape and a number of metal connection pieces 12 having elasticity are secured to a connector housing 13. The metal connection pieces 12 are arranged in a staggered fashion so that contact portions 12*a* are staggered with each other, and U-turn portions 12*b* are opposed to each other. A number of (34 in the illustrated embodiment) metal connection pieces 12 are disposed within a small housing space.

Figure 4:
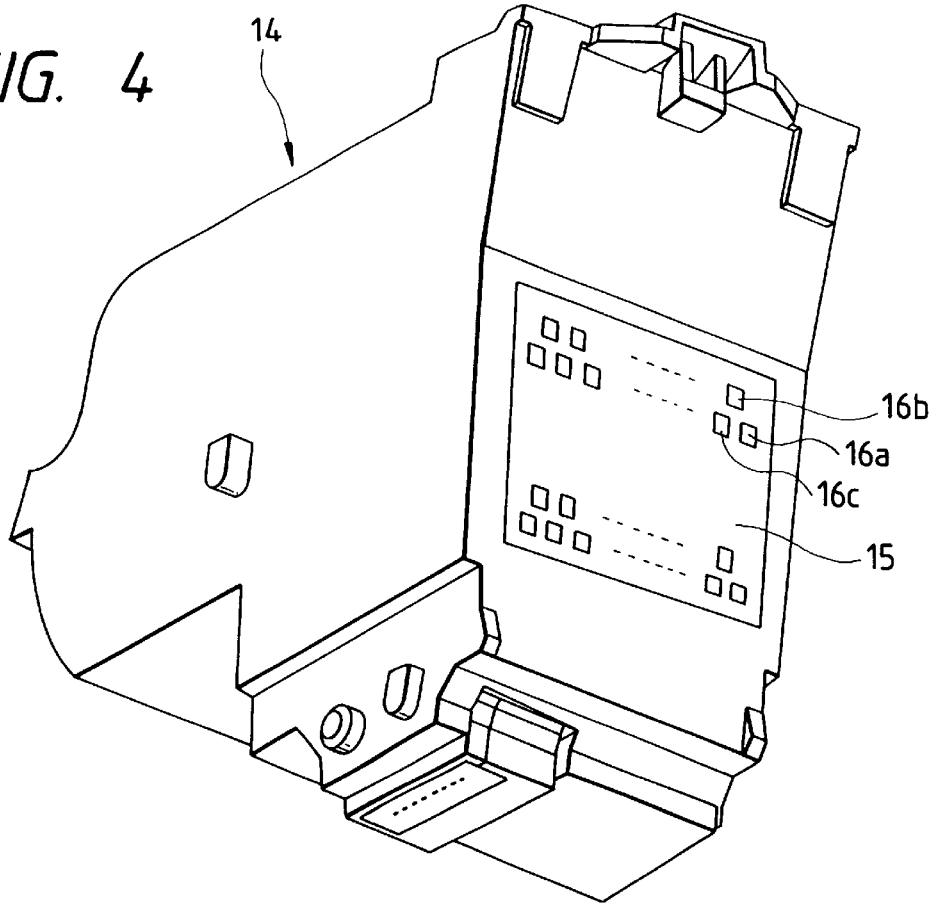
FIG. 4 is a perspective view for explaining a head cartridge opposed to the carriage of FIG. 1.

On the other hand, a head cartridge 14 as an example of the cartridge has an ink jet recording head for discharging ink from discharge ports and, as shown in FIG. 4, a wiring board 15 is provided on a rear surface of the head cartridge. Contact pads 16 are located at positions corresponding to the metal connection pieces 12. Of course, the contact pads 16 are arranged in a staggered fashion. Since the adjacent contact pads (for example, 16*b* and 16*c*) are staggered with each other, adequate contact pad areas can be preserved. As a result, since a contact pitch can be shortened, the increase in the number of contacts can be coped with, without making the connectors 10, 11 bulky.

Figure 5:
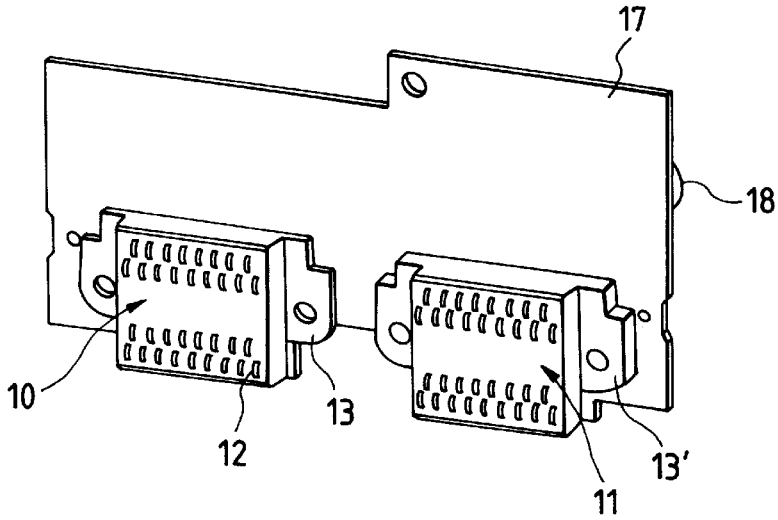
FIG. 5 is a perspective view for explaining a contact substrate according to the first embodiment.
Figure 6:
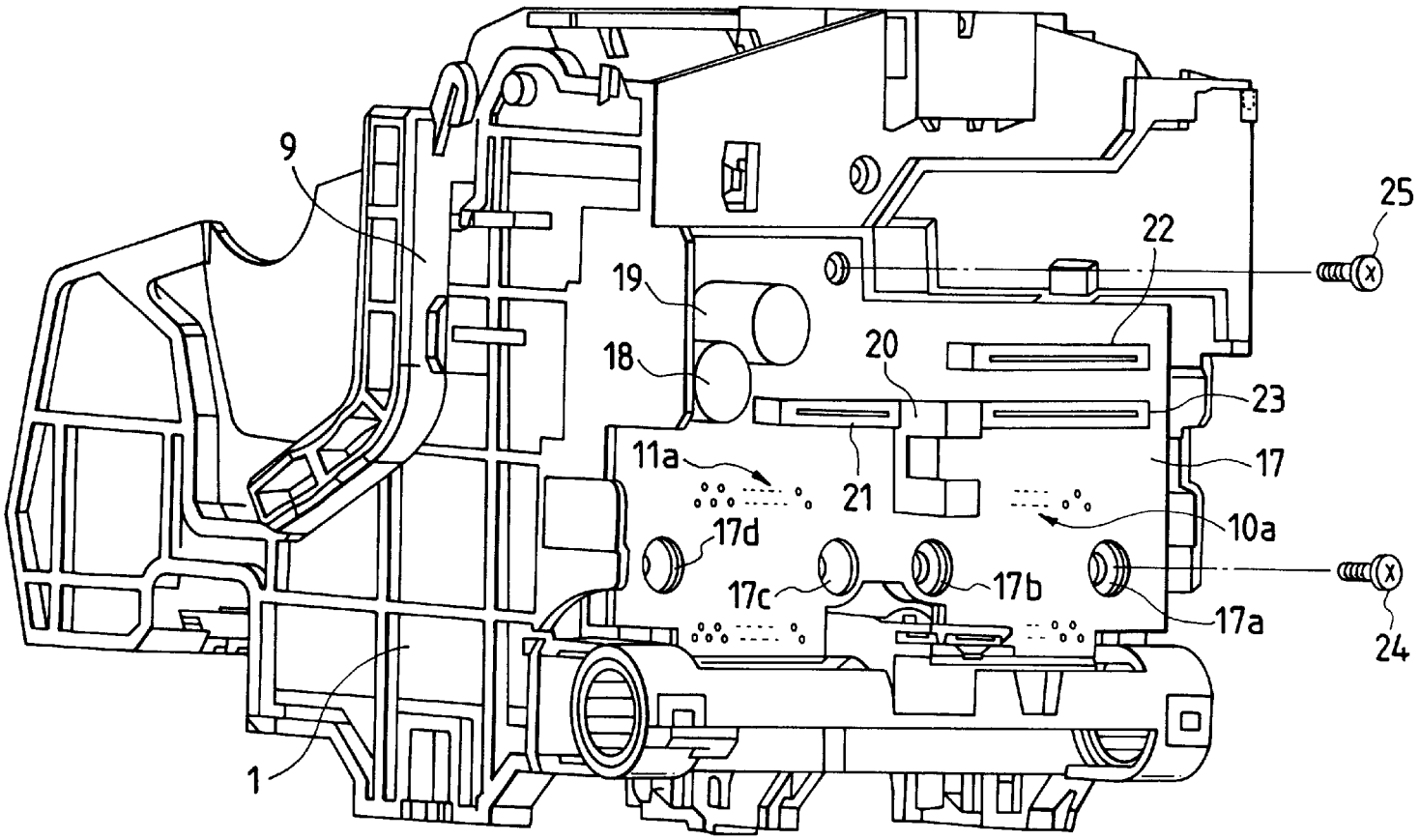
FIG. 6 is a perspective view for explaining mounting of the connector according to the first embodiment.

Next, the mounting of the connectors 10, 11 will be explained with reference to FIGS. 5 and 6.

The connectors 10, 11 are welded to a contact substrate (electrical part substrate) 17 on which capacitors 18, 19, a position detecting sensor 20 and flexible cable connectors 21, 22, 23 are mounted.

Figure 7:
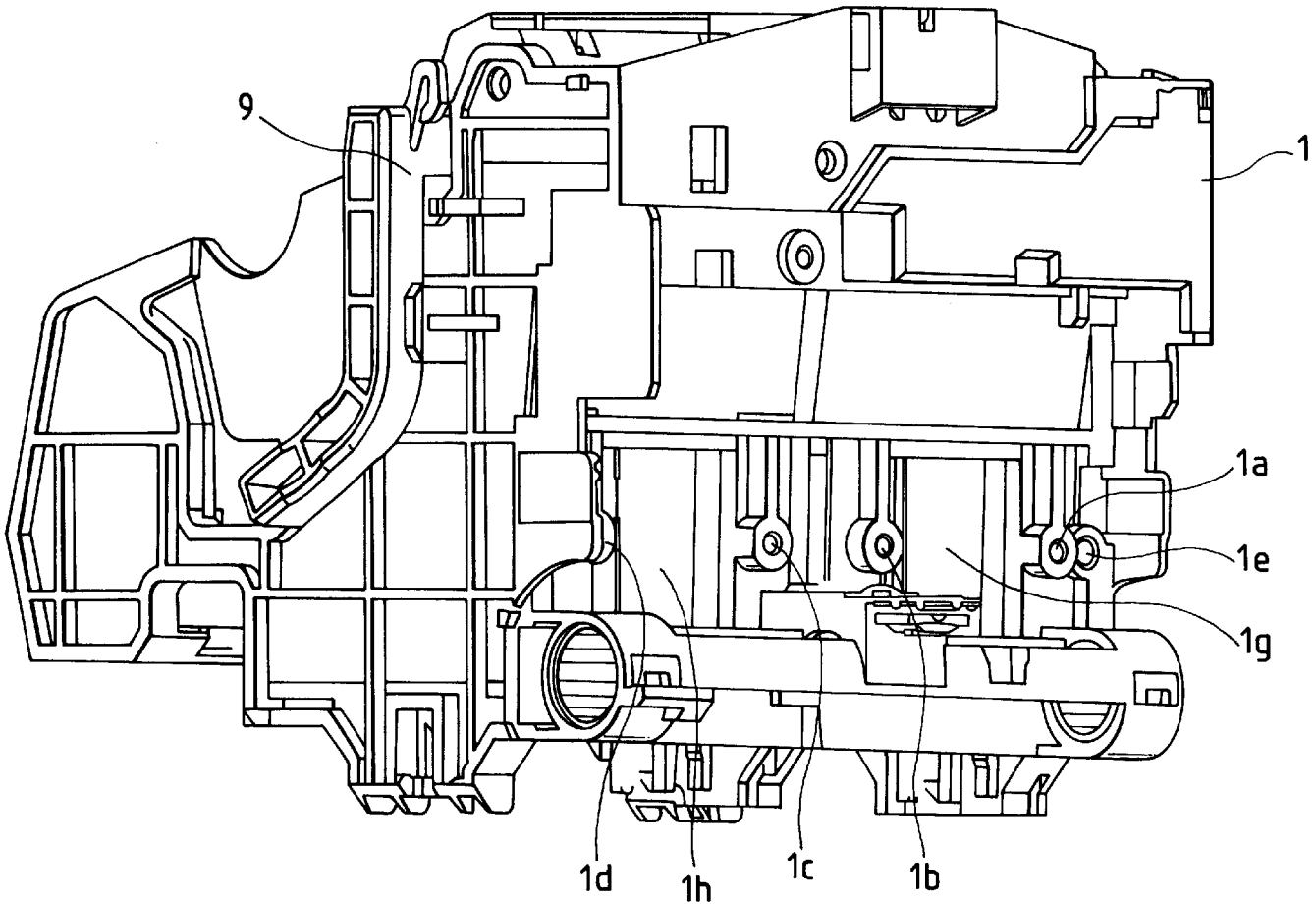
FIG. 7 is a perspective view of the carriage, with the contact substrate omitted from FIG. 6.

After the contact substrate 17 is installed at a predetermined position on the carriage 1 so that the connectors 10, 11 are inserted through openings 1*g*, 1*h* formed in the rear surface of the carriage as shown in FIG. 7, the connectors 10, 11 are directly secured to the carriage 1 by screws 24. In the illustrated embodiment, four screws 24 are used, and each connector is positively secured to the carriage 1 by two screws 24. Thus, if a reaction force ($0.75\times34\cong2.6$ kg in the illustrated embodiment) due to maximum contact pressure is received, the connector housing 13 can be maintained in the predetermined position, thereby ensuring the contact pressure of the metal connection pieces 12.

In the illustrated embodiment, screw escape holes 17*a*, 17*b*, 17*c*, 17*d* are formed in the contact substrate 17, so that the screws 24 can be threaded into threaded holes 1*a*, 1*b*, 1*c*, 1*d* formed in the carriage through the housings 13, 13' without contacting with the contact substrate 17.

With this arrangement, a floating condition between the connectors 10, 11 and the contact substrate 17 caused when the connectors 10, 11 and the contact substrate 17 are secured to the carriage 1 together (i.e., when the contact substrate is tightened while contacting the screws 24 with the contact substrate) can be prevented, thereby preventing great stress from acting on welded portions 10*a*, 11*a* of the connectors, and, thus, ultimately preventing the floating of connectors and cracking of the substrate.

Incidentally, the positioning of the housings 13, 13' of the connectors with respect to the carriage 1 is effected by inserting positioning pins (not shown) into positioning holes 1*e*, 1*f* formed in the carriage 1.

In a condition that the four screws 24 are tightened, although the contact substrate 17 is temporarily secured via the welded portions 10*a*, 11*a*, it is desirable that, lastly, the contact substrate 17 is secured to the carriage 1 by a screw 25 at a position spaced apart from the welded portion 10*a* as much as possible.

In the illustrated embodiment, two head cartridges 14 installed in the pockets 2, 3 of the carriage 1 are deviated from each other in a sheet feeding direction in order to prevent the spreading of ink. To this end, two kinds of connectors 10, 11 having housings 13, 13' of different height are used in order to compensate for such deviation.

However, even in a carriage in which only a single head cartridge 14 is installed, it should be understood that the above-mentioned connecting method for connecting between the carriage, connector and contact substrate can be used.

Further, as shown in FIG. 3, since each of the elastic metal connection pieces 12 of the connector 10 is displaced around the U-turn portion 12*b* when the contact pressure is applied from a direction shown by the arrow X, the contact portion 12*a* is deviated also in a direction shown by the arrow Y (as shown by the broken line). Due to such lateral deviation, even if foreign matters are adhered to the contact portions 12*a* or the contact pads 16 of the head cartridge 14, by removing such foreign matters, good contacting condition can be maintained.

Second Embodiment

FIGS. 9 to 13 show a second embodiment of the present invention. Similar to the first embodiment, two connectors 10 are welded to a contact substrate 30. However, a positioning spacer 31 is pinched between the substrate and the connectors. The positioning spacer 31 is provided with positioning pins 31*a*, 31*b* with respect to the carriage 1 and connector positioning holes (not shown) so that two connectors 10 can be positioned with respect to the carriage 1 with high accuracy.

In the above-mentioned first embodiment, two head cartridges 14 mounted to and installed in the pockets 2, 3 of the carriage 1 are deviated from each other in the sheet feeding direction (from a front side to a rear side of the carriage in FIG. 1) in order to prevent the spreading of ink. To this end, two kinds of connectors 10, 11 having housings 13, 13' of different height are used in order to compensate for such deviation.

In the second embodiment, in order to constitute a housing by one kind of parts having the same height, a positioning spacer 31 having an attaching surface with steps of different heights is provided. Since the positioning of two connectors 10 with respect to the carriage 1 is effected by the highly accurate positioning spacer 31, the attaching accuracy is further improved. Thus, identical parts can be used in a plurality of connectors, thereby preventing error regarding management of connector parts and attachment of connectors.

Now, the second embodiment will be fully explained with reference to the accompanying drawings. Incidentally, the construction of the second embodiment is the same as that in the first embodiment, except for special description.

Figure 9:
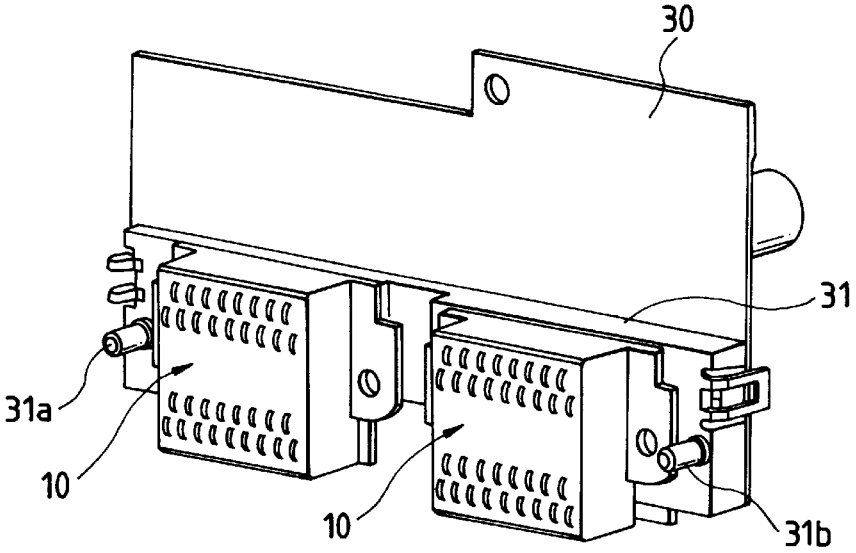
FIG. 9 is a perspective view for explaining a contact substrate according to a second embodiment of the present invention.

FIG. 9 shows the spacer 31 and two connectors 10 mounted on the rear surface of the contact substrate 30 having a front surface on which the capacitors and the positioning detecting sensor or flexible cable connectors are mounted. The spacer 31 is secured to the contact substrate by welding.

Figure 10:
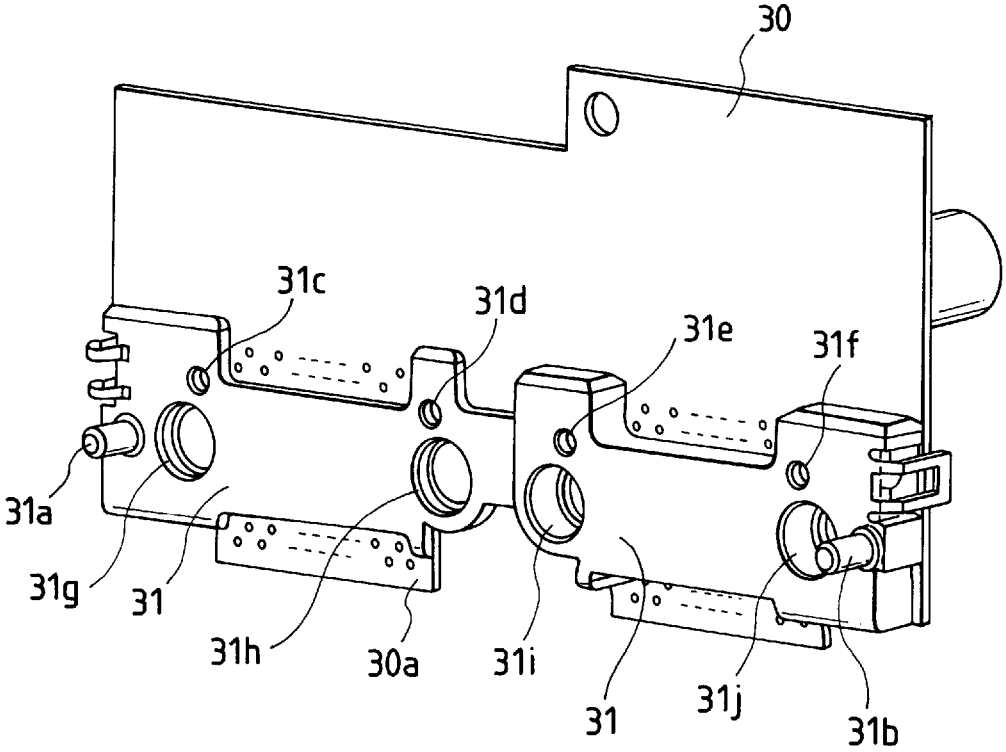
FIG. 10 is a view similar to FIG. 9, with contact omitted from FIG. 9.
Figure 11:
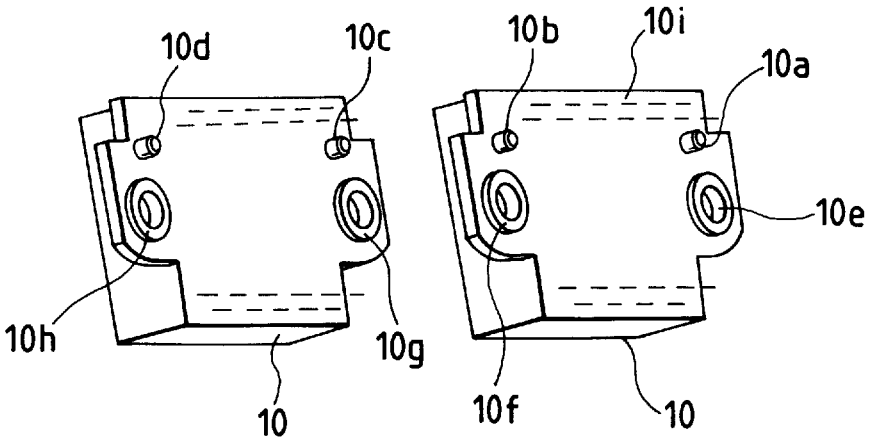
FIG. 11 is a rear perspective view of the contacts.
Figure 12:
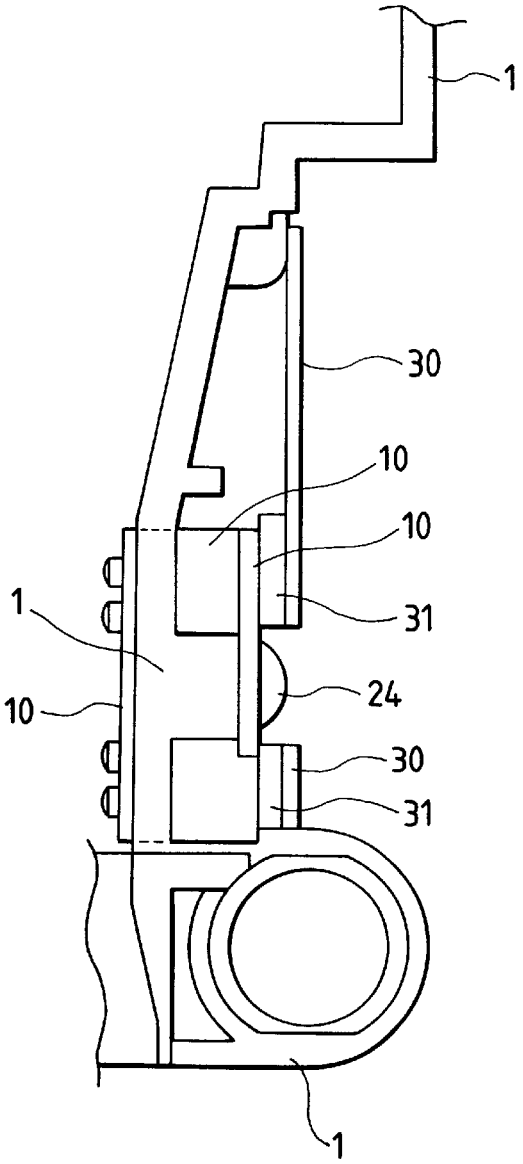
FIG. 12 is a schematic rear sectional view of the carriage.

FIG. 10 shows an arrangement shown in FIG. 9, with the connectors 10 omitted. Further, FIG. 11 shows rear surfaces of the connectors 10 (by which the connectors are mounted on the spacer 31).

The connectors 10 are positioned with respect to the spacer 31 with high accuracy by inserting positioning pins 10*a*, 10*b*, 10*c*, 10*d* into positioning holes 31*c*, 31*d*, 31*e*, 31*f* of the spacer 31. In this case, a number of electrical connecting lead pins 10*i* formed on the rear surfaces of the connectors 10 are protruded from the contact substrate through holes 30*a* provided in the spacer 31 and are welded to the contact substrate.

The spacer 31 in which the connectors 10 are positioned in this way is secured to the contact substrate, thereby obtaining an arrangement shown in FIG. 9.

Two connectors 10 are exposed in the interior of the carriage through the openings 1*g*, 1*h* formed in the rear surface of the carriage 1. In this case, the positioning pins 31*a*, 31*b* of the positioning spacer 31 are inserted into the positioning holes 1*e*, 1*f* of the carriage 1, thereby positioning the spacer 31 with respect to the carriage 1.

Figure 8:
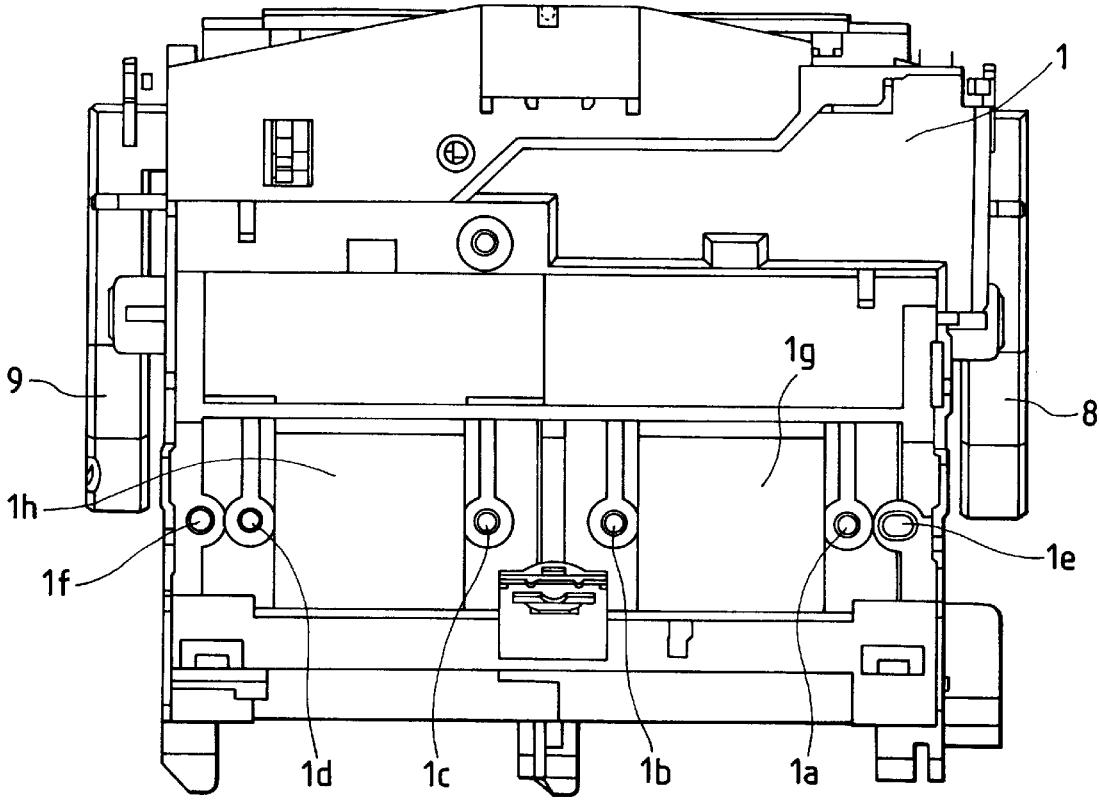
FIG. 8 is a rear view of the carriage of FIG. 7.

Holes of the contact substrate (corresponding to the holes 17*a*, 17*b*, 17*c*, 17*d* in FIG. 6) and screw receiving holes of the carriage (corresponding to the holes 1*a*, 1*b*, 1*c*, 1*d* in FIG. 7 or 8) and screw receiving holes 10*e*, 10*f*, 10*g*, 10*h* are secured to each other by the screws 24 in such a manner that the screws 24 are not contacted with holes 31*g*, 31*h*, 31*i*, 31*j* of the spacer 31 (i.e., the contact substrate and the spacer are not substantially secured together by the screws). In this way, similar to the first embodiment, since the contact substrate 30 and the positioning spacer 31 have the screw escape holes and two connectors are directly secured to the carriage 1 by the screws (refer to FIG. 12), an external force caused by the screw connection does not act on the contact substrate 30, with the result that the connectors 10 can be attached to the carriage 1 at correct positions positively.

Figure 13:
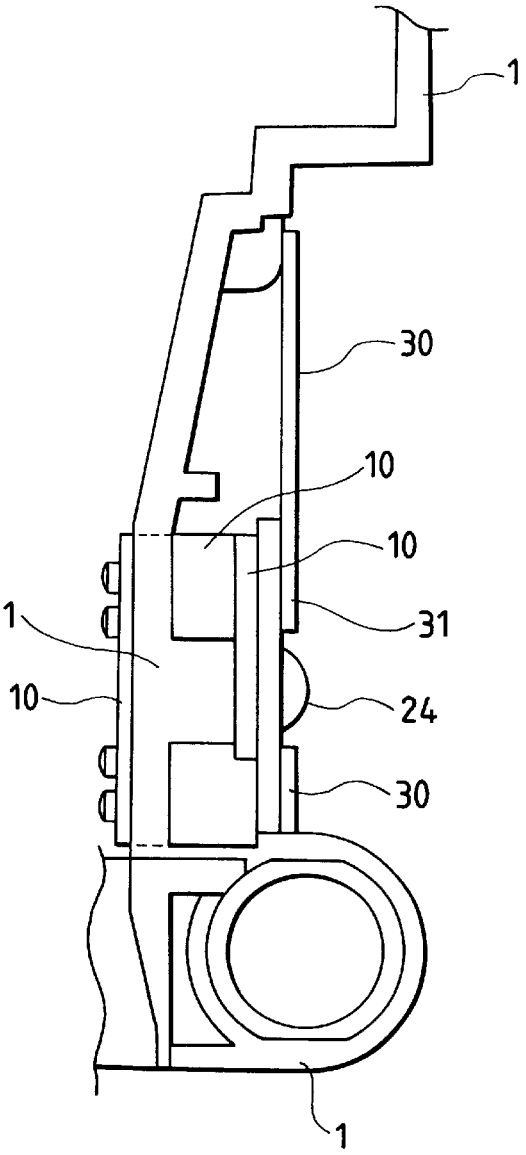
FIG. 13 is a schematic rear sectional view of another carriage.

In the first and second embodiments, the screw escape holes may be formed only in the contact substrate 30 and the connectors and the positioning spacer 31 may be secured together to the carriage 1 by the screws (refer to FIG. 13). Further, the number of the connectors to be attached to the carriage is not limited two, but may be one, or three or more.

Third Embodiment

Figure 14:
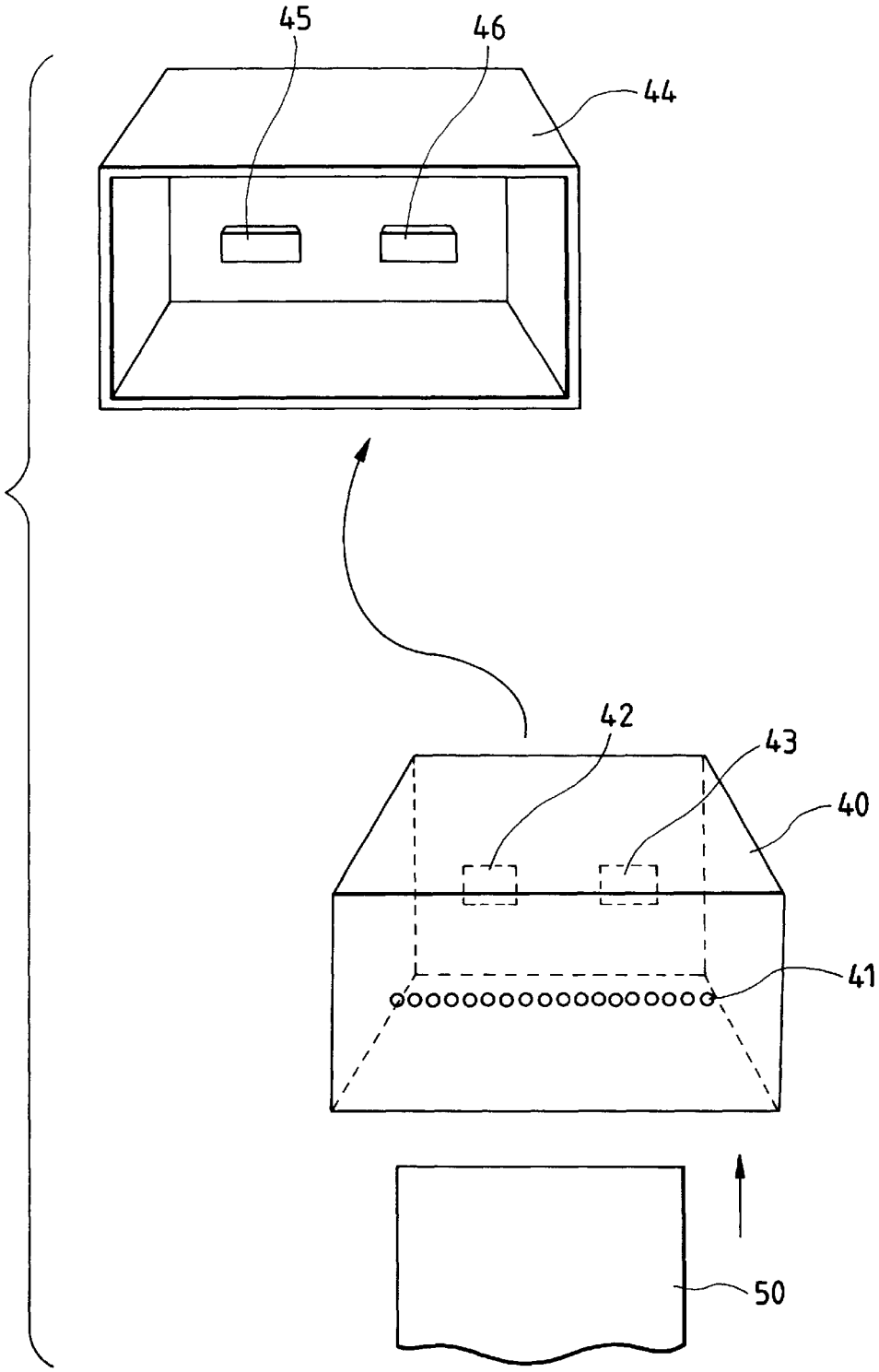
FIG. 14 is a schematic view showing a third embodiment of the present invention.

FIG. 14 shows a third embodiment of the present invention.

An ink jet recording head 40 of full-line type is installed in such a manner that ink discharge ports 41 are arranged in a direction perpendicular to a conveying or feeding direction for a recording medium 50. The ink discharge ports 41 of the ink jet recording head 40 of full-line type permit the recording of the entire area in a width-wise direction (perpendicular to the recording medium conveying direction (direction shown by the arrow in FIG. 14)) of the recording medium 50 without shifting the ink jet recording head in a direction along which the ink discharge ports are arranged.

Connectors 42, 43 for effecting electrical connection to an external equipment are provided on a rear surface of the ink jet recording head 40. The ink jet recording head 40 is mounted on a head mounting member 44, and the connectors 42, 43 of the head are connected to connectors 45, 46 of the head mounting member.

In this embodiment, the connectors 45, 46 correspond to the connectors 10, 11 in the first or second embodiment, and the head mounting member 44 corresponds to the carriage 1.

In the first or second embodiment, while the recording apparatus of serial type was explained, the present invention can be well applied to a recording apparatus of so-called full-line type. Particularly, in the recording head of full-line type in which the number of ink discharge ports (as recording unit) is greater than that in the recording head of serial type, the number of electrical contacts is naturally increased, and, thus, an urging force generated by the metal contacts becomes greater than that in the recording head of serial type. Therefore, the present invention which can suppress the influence of the external force upon the contact substrate is more effective for the full-line type.

The ink jet recording head according to the present invention may be an ink jet recording head which has an electrothermal converting element (not shown) and discharges ink from the discharge port utilizing thermal energy generated by the electrothermal converting element.

As mentioned above, according to the above-mentioned embodiments, when the contact substrate having the connector comprised of a number of elastic metal connection pieces is secured to the carriage, damage of the welded portions of the connector and cracking of the print substrate can be prevented.

Further, since the connector is directly secured to the carriage by the attaching members, even if the reaction force of the elastic metal connection pieces acts on the connector, the connector housing is not shifted from the predetermined position. Thus, a good contacting condition of the elastic metal connection pieces can be maintained.

In addition, when the contact substrate having a plurality of connectors each comprised of a number of elastic metal connection pieces is secured to the carriage, by positioning the carriage and the connectors with the interposition of the spacer, the positioning accuracy of the carriage and the connectors can be improved greatly, as well as the above-mentioned effect.

Further, when the plurality of head cartridges are deviated from each other in the sheet feeding direction, by absorbing such deviation by means of the spacer, since the identical connectors can be used, management of parts can be facilitated and cost can be reduced.

What is claimed is:

1. A recording apparatus having a cartridge mounting member to which a cartridge is detachably mountable, comprising:

a connector for effecting electrical connection to said cartridge and having a first attached portion for receiving an attaching member for attaching said connector to said cartridge mounting member;

a second attached portion provided on said cartridge mounting member for receiving said attaching member when said connector is attached to said cartridge mounting member; and a substrate adapted to hold said connector and having a configuration such that said substrate is not contacted with said attaching member when said first and second attached portions are interconnected by said attaching member.

2. A recording apparatus according to claim 1, wherein said attaching member comprises a screw.

3. A recording apparatus according to claim 1 or 2, wherein said cartridge mounting member comprises a carriage shiftable along a recording medium, and said cartridge comprises an ink jet recording head for discharging ink from an ink discharge port thereof.

4. A recording apparatus according to claim 3, wherein said ink jet recording head has an electrothermal converting element and discharges the ink from the discharge port utilizing thermal energy generated by said electrothermal converting element.

5. A recording apparatus according to claim 1 or 2, wherein said cartridge comprises an ink jet recording head of a full-line type having a plurality of ink discharge ports disposed along an entire width of a recording medium, the width being transverse to a conveyance direction of the recording medium.

6. A recording apparatus having a carriage capable of removably mounting a head cartridge, said apparatus comprising:

a connector for electrically connecting a contact pad of said head cartridge, said connector having an elastic metal connecting piece; and a contact substrate for holding said connector, said contact substrate having such shape that when said connector is fixed to said carriage by an attaching member, said contact substrate is not in contact with said attaching member.

7. A recording apparatus according to claim 6, wherein said attaching member comprises a screw.

8. A recording apparatus according to claim 6, wherein said elastic metal connection piece of said connector is of a stepped, zigzag configuration.

9. A recording apparatus according to claim 6, wherein a contacting portion of said elastic metal connecting piece contacting said contact pad varies as said elastic metal connecting piece of said connector is in contact under pressure with said contact pad.

10. A recording apparatus according to claim 6, wherein said connector is fixed to said carriage in a direction in which said connector is applied with a counter force of said elastic metal connecting piece.

11. A recording apparatus according to claim 6, wherein said carriage is capable of removably mounting a plurality of head cartridges.

12. A recording apparatus according to claim 6, wherein said head cartridge comprises an ink jet recording head for discharging ink to record an image.

13. A recording apparatus according to claim 12, wherein said ink jet recording head records the image by an ink droplet formed by thermal energy.

14. A recording apparatus having a carriage capable of removably mounting a head cartridge, said apparatus comprising:

a plurality of connectors for electrically connecting a contact pad of said head cartridge, said connectors each having an elastic metal connecting piece;

a contact substrate for holding said plurality of connectors; and a spacer interposed between said plurality of connectors and said contact substrate, said carriage and said plurality of connectors being positioned by said spacer, and said contact substrate having such shape that when said connectors are fixed to said carriage by an attaching member, said contact substrate is not in contact with said attaching member.

15. A recording apparatus according to claim 14, wherein said attaching member comprises a screw.

16. A recording apparatus according to claim 14, wherein said elastic metal connecting piece of each said connector is of a stepped, zigzag configuration.

17. A recording apparatus according to claim 14, wherein a contacting portion of each said elastic metal connecting piece contacting said contact pad varies as said elastic metal connecting piece of each said connector is in contact under pressure with said contact pad.

18. A recording apparatus according to claim 14, wherein each said connector is fixed to said carriage in a direction in which each said connector is applied with a counter force of said elastic metal connecting piece.

19. A recording apparatus according to claim 14, wherein said head cartridge comprises an ink jet recording head for discharging ink to record an image.

20. A recording apparatus according to claim 19, wherein said ink jet recording head records the image by an ink droplet formed by thermal energy.

21. A method for attaching an electrical substrate to a cartridge mounting member to which a cartridge is detachably mountable, comprising the steps of:

providing, on a connector for effecting electrical connection to the cartridge, a first attached portion for receiving an attaching member for attaching the connector to the cartridge mounting member;

providing, on the cartridge mounting member, a second attached portion for receiving the attaching member when the connector is attached to the cartridge mounting member; and providing an escape portion in the substrate for holding the connector so that the substrate does not interfere with the attaching member when the first and second attached portions are secured to each other by the attaching member.

22. A recording apparatus having a carriage capable of removably mounting a head cartridge, said apparatus comprising:

a connector for electrically connecting a contact pad of said head cartridge, said connector having an elastic metal piece; and a contact substrate for holding said connector, said contact substrate having such shape that when said connector is fixed to said carriage by an attaching member, said contact substrate has a relief for said attaching member.

* * * * *